US005690184A

United States Patent [19]

Tsuchiya

[11] Patent Number: 5,690,184

[45] Date of Patent: Nov. 25, 1997

[54] ROCK DRILLING APPARATUS

[75] Inventor: Toshiro Tsuchiya, Hiroshima-ken, Japan

[73] Assignee: Fujita Corporation, Tokyo, Japan

[21] Appl. No.: 615,608

[22] Filed: Mar. 13, 1996

[30] Foreign Application Priority Data

Apr. 20, 1995 [JP] Japan ..... 7-119300

[51] Int. Cl.[6] ..... E21B 19/08

[52] U.S. Cl. ..... 175/220; 173/185

[58] Field of Search ..... 175/45, 52, 108, 175/220; 173/160, 11, 185, 38; 408/11, 14

[56] References Cited

U.S. PATENT DOCUMENTS

| | | | |
|---|---|---|---|
| 3,584,524 | 6/1971 | Langenbach | 408/11 |
| 3,628,614 | 12/1971 | Brennan | 173/29 |
| 3,804,544 | 4/1974 | Adams | 408/14 |
| 3,807,512 | 4/1974 | Pogonowski et al. | 175/106 |
| 3,902,561 | 9/1975 | Friberg et al. | 175/52 |
| 4,681,170 | 7/1987 | Ohi | 173/50 |
| 5,113,951 | 5/1992 | Houben et al. | 173/75 |
| 5,133,418 | 7/1992 | Gibson et al. | 175/45 |
| 5,358,060 | 10/1994 | Ebara | 175/108 |

FOREIGN PATENT DOCUMENTS

| | | |
|---|---|---|
| 2289788 | 11/1990 | Japan . |
| 63104 | 1/1994 | Japan . |

*Primary Examiner*—Frank Tsay

*Attorney, Agent, or Firm*—Weiner, Carrier, Burt & Esser, P.C.; Joseph P. Carrier; Irving M. Weiner

[57] ABSTRACT

A rock drilling apparatus includes a frame having a front end, a guide rod supported on the front end of the frame, a rotary rod extending parallel to the guide rod and supported on the frame for rotation about its own axis and longitudinal movement beyond the front end of the frame, and a drill bit mounted on a front tip end of the rotary rod. The guide rod comprises a shank fixed to the front end of the frame and a tubular member extending substantially fully over the shank and rotatably disposed around the shank.

19 Claims, 4 Drawing Sheets

ROCK DRILLING APPARATUS

BACKGROUND OF THE INVENTION

1. Field of the Invention

The present invention relates to a rock drilling apparatus for drilling a plurality of holes closely together in a rock to form a trench therein.

2. Description of the Related Art

Tunneling in a hard rock by blasting it with an explosive such as dynamite has been the mostly widely used of all methods of rock excavation.

However, certain environmental concerns prevent explosives from being used in excavating rocks because of intensive noise and vibration produced when explosives are detonated. One of other processes available as an alternative to blasting is a rock excavating process which uses a hydrostatic rock disintegrator.

As a matter of fact, the blasting process has been replaced by the rock excavating process using the hydrostatic rock disintegrator in more and more occasions for breaking rocks and massive concrete structures such as retaining walls because the latter process is free from intensive noise and vibration.

The hydrostatic rock disintegrator comprises a slender rubber body having a plurality of side walls and a central hole extending longitudinally therein, a rubber tube mounted in the central hole, and a plurality of loading plates of metal installed in covering relation to outer surfaces of the side walls of the rubber body and extending end to end in the longitudinal direction of the rubber body. The rubber tube has one end closed and the other end connected to a pressurized water supply through a pressure-resistant hose. The hydrostatic rock disintegrator is of a substantially cylindrical slender shape in its entirety. The hydrostatic rock disintegrator has a diameter of about several inches and a length of several feet, for example. When water is supplied under pressure from the pressurized water supply through the pressure-resistant hose into the rubber tube, the rubber tube and the rubber body are expanded radially outwardly. As a result, the diameter of the hydrostatic rock disintegrator increases.

For excavating a tunnel with hydrostatic rock disintegrators, a plurality of holes, each having a diameter substantially equal to the outside diameter of the hydrostatic rock disintegrator are formed in a row in the face of a tunnel, and the hydrostatic rock disintegrators are inserted respectively into the holes. Then, water is supplied under pressure to the hydrostatic rock disintegrators to increase their diameters. Large forces are applied from the loading plates to inner walls of the holes, thereby breaking the rock substantially along the holes.

In order to allow the hydrostatic rock disintegrators which are less powerful than explosives to easily break the rock, it is customary to form a trench in the face along the profile of the tunnel and also a plurality of trenches in the face to divide the face into a plurality of relatively small sections, and then to break the rock of the face with the hydrostatic rock disintegrators. Since the face has already been divided into the sections by the trenches, the face can easily be broken by the hydrostatic rock disintegrators.

To form a trench in the tunnels' face, a plurality of holes are drilled in the face at a pitch substantially equal to the diameter of the holes. Since the holes are successively drilled very closely to each other, when a new hole is drilled next to an existing hole, the wall of rock between these holes is broken. In this manner, a continuous trench is formed along the holes as they are successively drilled.

The rock excavating process using the hydrostatic rock disintegrator may be used in other applications than the excavation of tunnels. In those other applications, trenches are often formed in the same manner as described above.

A plurality of holes for producing a trench are generally formed by a drilling apparatus which will be described below.

The drilling apparatus comprises a positionable frame, a rotary rod rotatably and axially movably mounted on the frame and actuatable by a suitable means, and a drill bit mounted on the tip end of the rotary rod.

When a single hole is formed in a rock by the drilling apparatus, since the fully circumferential wall of the hole is left intact, radial forces acting from the wall of the hole on the drill bit cancel each other, and hence the combination of those radial forces is relatively small. However, when a plurality of holes are formed in a row by the drilling apparatus to form a trench, since the wall of rock between an existing hole and a new hole is broken as the new hole is being drilled, the combination of radial forces acting on the drill bit is large and directed toward the existing hole.

Therefore, the drill bit as it drills the new hole tends to be displaced radially off a desired position under the combination of radial forces thus applied. To prevent the drill bit from being displaced, it has been a conventional practice to use a guide rod mounted on the frame parallel to the rotary rod and having a diameter which is substantially the same as or slightly smaller than the diameter of holes to be formed. Before a new hole is drilled, the guide rod is inserted into an existing hole next to the position of the new hole, for thereby stabilizing the frame. The guide rod placed in the existing hole prevents the frame from being shifted in position even when large radial forces are imposed on the rotary rod as it drills the new hole. When the drill bit progressively drills the new hole, the rotary rod is actuated to project forward from the frame into the new hole.

The above drilling apparatus, however, suffers the following problems.

The holes for forming a trench have a depth much greater than their diameter. Therefore, the rotary rod is necessarily of a slender shape. Since a sufficient clearance has to be kept between the inner wall of a hole being drilled and the rotary rod for discharging broken rock fragments, the rotary rod is not allowed to have a large thickness and sufficient rigidity. When the rotary rod projects largely from the frame as the drill bit progressively drills a new hole, the rotary rod flexes radially toward the guide rod under large radial forces described above, with the result that the drill bit on the tip end of the rotary rod may possibly interfere with a side surface of the guide rod. If drill bit interferes with the side surface of the guide rod, then edges of the drill bit and/or the side surface of the guide rod is worn and/or broken. Therefore, the guide rod and/or the drill bit require frequent replacement, resulting in a significant reduction in the efficiency of operation of the drilling apparatus.

SUMMARY OF THE INVENTION

It is therefore an object of the present invention to provide a rock drilling apparatus which prevents a guide rod and a drill bit from being worn or damaged due to contact therebetween for thereby increasing the efficiency of operation of the rock drilling apparatus.

According to the present invention, a rock drilling apparatus includes a frame having a front end, a guide rod supported on the front end of the frame, a rotary rod extending parallel to the guide rod and supported on the frame for rotation about its own axis and longitudinal movement beyond the front end of the frame, and a drill bit mounted on a front tip end of the rotary rod. The guide rod comprises a shank fixed to the front end of the frame and a tubular member extending substantially fully over the shank and rotatably disposed around the shank.

While the rock drilling apparatus is drilling a hole, if the rotary rod is flexed and an outer circumferential surface of the drill bit is brought into contact with the guide rod, the tubular member is rotated by the rotation of the drill bit.

Any friction between the outer circumferential surface of the drill bit and the outer circumferential surface of the tubular member is very small, and the drill bit and the tubular member are substantially not worn. The guide rod and the drill bit are thus prevented from being damaged or broken.

The guide rod and the drill bit do not need to be frequently replaced, and hence the efficiency of operation of the rock drilling apparatus is high.

Even if the guide rod and the drill bit unduly frictionally interfere with each other, the drill bit which is harder than the tubular member is not broken, but only the tubular member tends to be broken or damaged, and may be replaced with a new one. Consequently, the rock drilling apparatus is highly economical.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
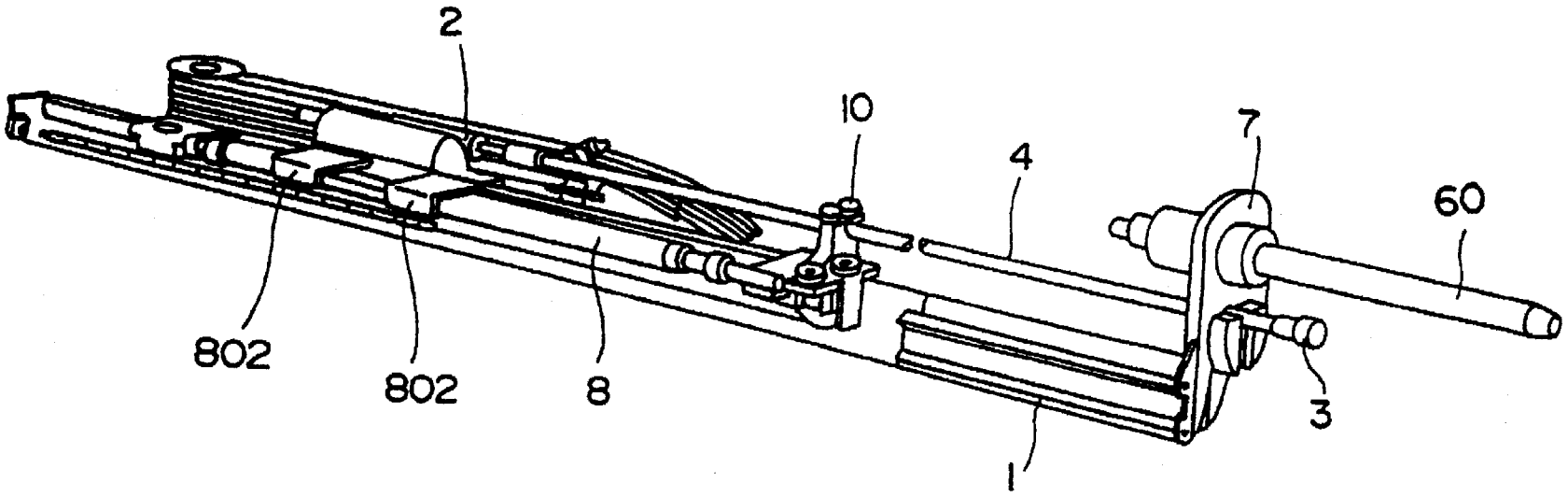
FIG. 1 is a perspective view of a rock drilling apparatus according to the present invention.

As shown in FIG. 1, a rock drilling apparatus according to the present invention has a frame 1 having a front end shown on the right-hand side in FIG. 1 and a rear end shown on the left-hand side in FIG. 1. The frame 1 is mounted on the tip end of a robot arm (not shown), for example, of a manipulator for positioning the rock drilling apparatus in a target position.

The frame 1 has a upstanding bracket 7 on its front end. The rock drilling apparatus includes a rotary rod 4 mounted on the frame 1 and extending above and parallel to the frame 1. The rotary rod 4 has a front end extending through the bracket 7 and supported by the bracket 7 for rotation and longitudinal movement.

A drill bit 3 is mounted on the front tip end of the rotary rod 4 which projects forward from the bracket 7. The rotary rod 4 is of a hollow structure having an axial central hole (not shown) which is connected to a plurality of openings 3*b* (see FIG. 3) defined in a front end surface of the drill bit 3.

When the rock drilling apparatus operates to drill a hole in a rock, water is introduced from the rear end of the rotary rod 4 into the axial central hole therein, and then ejected from the openings 3*b* of the drill bit 3.

The rotary rod 4 is rotatably and axially movably supported in its intermediate portion by a rod support 10 which is mounted on the frame 1 behind the bracket 7.

A drifter 2 is mounted on the frame 1 by brackets 802 behind the rod support 10 for movement in the longitudinal direction of the frame 1. The rear end of the rotary rod 4 is connected to the drifter 2 which rotates the rotary rod 4 about its own axis.

A hydraulic cylinder 8 is connected between the frame 1 and the brackets 802. When the hydraulic cylinder 8 is contracted or expanded, the drifter 2 is moved along the frame 1 through the brackets 802 to move the rotary rod 4 and the drill bit 3 in unison in the longitudinal direction of the frame 1.

A guide rod 60 is mounted on the bracket 7 above the rotary rod 4 and extends parallel to the rotary rod 4. The guide rod 60 is of a hollow structure for introducing air or water from its rear end and ejecting the introduced air or water from its front end.

Figure 2:
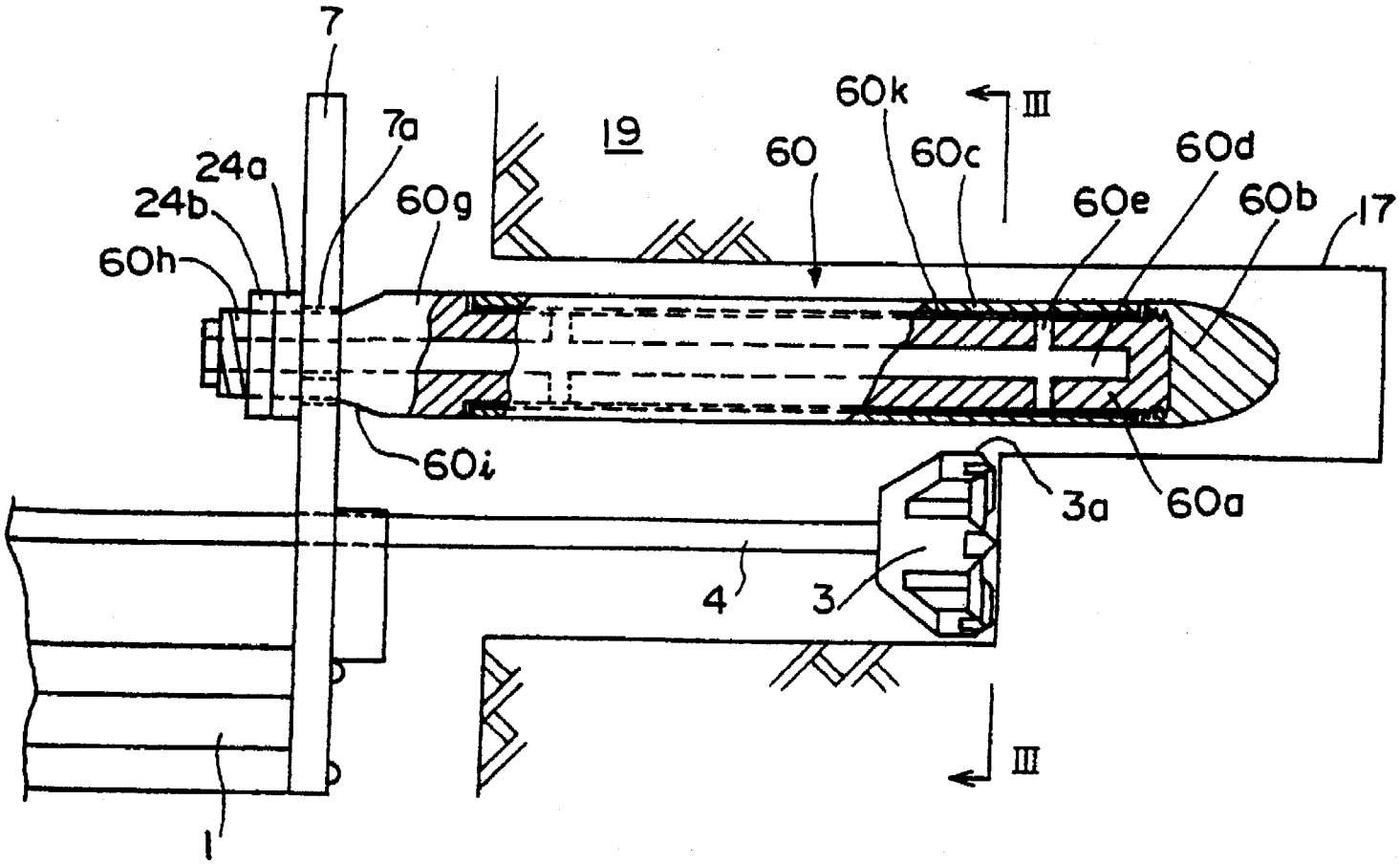
FIG. 2 is a fragmentary sectional side elevational view of a front portion of the rock drilling apparatus.
Figure 3:
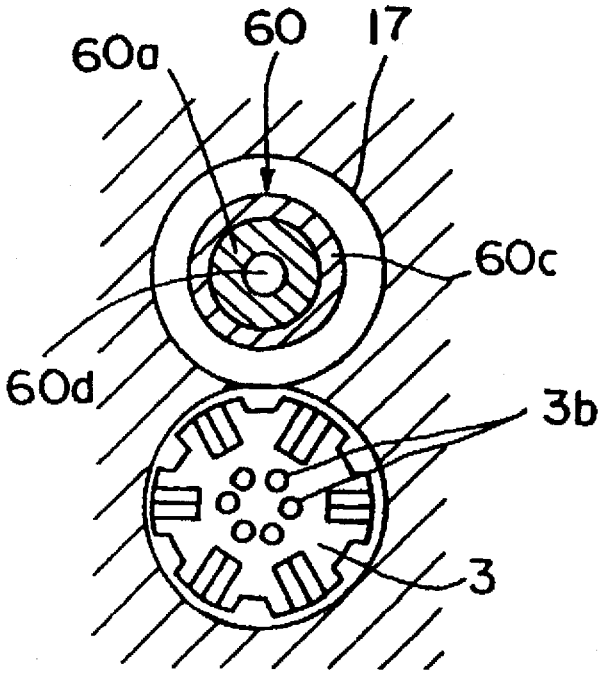
FIG. 3 is a cross-sectional view taken along line III—III of FIG. 2.

As shown in FIGS. 2 and 3, the guide rod 60 comprises a shank 60*a*, a tubular member 60*c* rotatably fitted over the shank 60*a*, and a cap 60*b* mounted on the front tip end of the shank 60*a*. The shank 60*a* is made of steel, for example, and the tubular member 60*c* is made of steel whose hardness is lower than the drill bit 3 and the shank 60*a*.

The shaft 60*a* has an outer circumferential bearing surface 60*k* extending from a proximal end portion 60*g* thereof shown on the left-hand side in FIG. 2 toward the front tip end thereof. The outer circumferential bearing surface 60*k* has a diameter slightly smaller than the proximal end portion 60*g* of the shaft 60*a*. The front tip end of the shank 60*a* is externally threaded, and the cap 60*b* is threaded over the externally threaded front tip end of the shank 60*a*.

The tubular member 60*c* is rotatably disposed around the outer circumferential bearing surface 60*k*, and is held against axial movement by a radial step between the proximal end portion 60*g* and the bearing surface 60*k* and the cap 60*b* which is threaded over the externally threaded front tip end of the shank 60*a*. The tubular member 60*c* has an outside diameter such that its outer circumferential surface lies substantially flush with an outer circumferential surface of the proximal end portion 60*g* near the bearing surface 60*k*.

The cap 60*b* has a proximal end portion having an outside diameter which is substantially the same as the outside diameter of the tubular member 60*c*. After the tubular member 60*c* is fitted over the shank 60*a*, the cap 60*b* is threaded over the externally threaded front tip end of the shank 60*a*, thereby retaining the tubular member 60*c* on the bearing surface 60*k*.

The shank 60*a* has an externally threaded proximal end 60*h* supported by the bracket 7. The externally threaded proximal end 60*h* has an outside diameter smaller than the outside diameter of the proximal end portion 60*g*, with a conical surface 60*i* extending from the proximal end portion 60*g* to the externally threaded proximal end 60*h*. The shank 60*a* has an axial central hole or passage 60*d* extending substantially the entire length thereof, for passing air or water therethrough. The hole 60*d* has a rear end open at the end of the externally threaded proximal end 60*h*. The front end of the hole 60*d* terminates short of the front end of the shank 60*a*. The bearing surface 60*k* has a plurality of holes defined therein near the front end of the shank 60*a* and connected to the hole 60*d* through respective radial holes 60*e* defined in the shank 60*a*.

The bracket 7 has an opening 7*a* defined therein, and the externally threaded proximal end 60*h* extends through the opening 7*a*. Nuts 24*a*, 24*b* are threaded over the externally threaded proximal end 60*h* which projects from the opening 7*a*. When the nuts 24*a*, 24*b* are tightened, the bracket 7 is securely held between the nuts 24*a*, 24*b* and the conical surface 60*i*, so that the guide rod 60 is firmly supported by the bracket 7.

FIGS. 4(A) through 4(E) show various modified guide rods having respective different structures by which the cap 60*b* is connected to the shank 60*a*. Those parts shown in FIGS. 4(A) through 4(E) which are identical to those shown in FIG. 2 are denoted by identical reference characters, and will not be described in detail.

Figure 4:
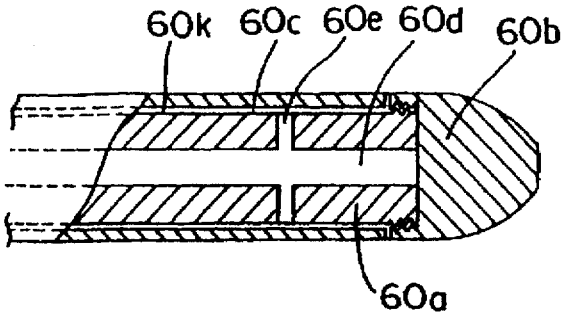
FIG. 4(A) through 4(E) are fragmentary sectional side elevational views of modified guide rods.
Figure 4:
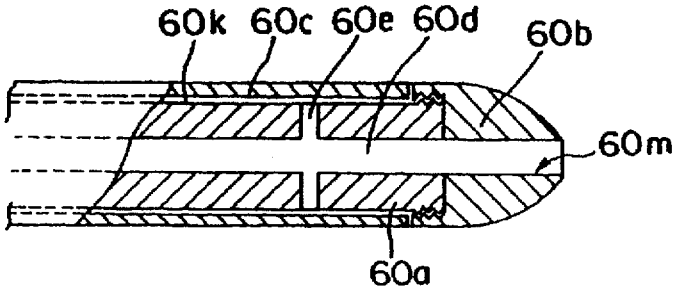
Figure 4:
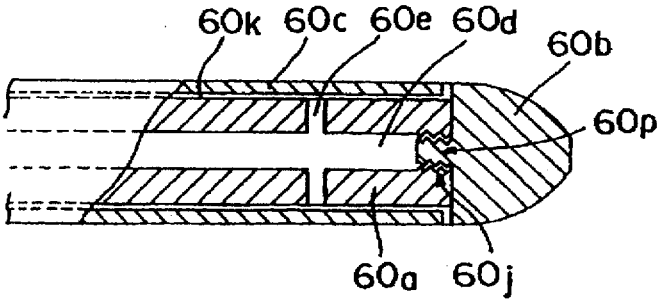
Figure 4:
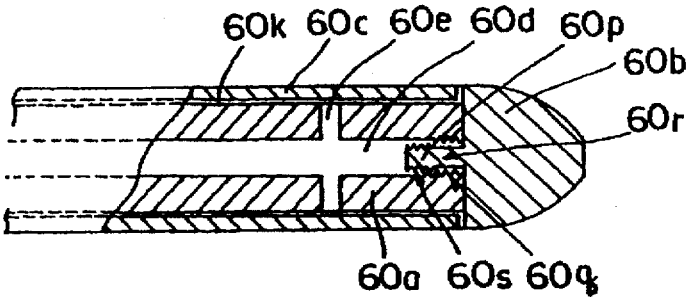
Figure 4:
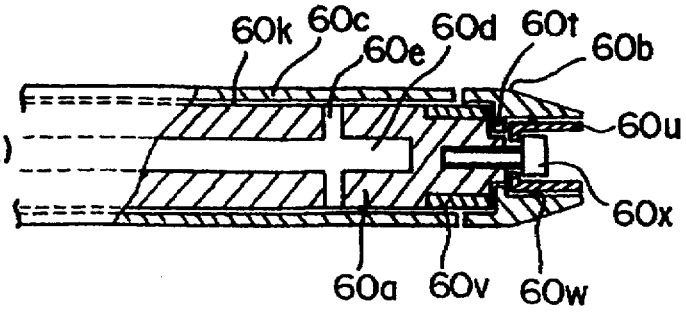

In FIG. 4(A), the axial central hole 60*d* in the shank 60*a* extends to and opens at the front end of the shank 60*a*.

In FIG. 4(B), the axial central hole 60*d* in the shank 60*a* extends to and opens at the front end of the shank 60*a*, and a hole 60*m* is defined centrally in the cap 60*b* in registry with the hole 60*d* for ejecting air or water from the tip end of the guide rod 60.

In FIG. 4(C), the front end of the shank 60*a* is not externally threaded. The axial central hole 60*d* in the shank 60*a* which extends to and opens at the front end of the shank 60*a* has an internally threaded surface 60*j*. The cap 60*b* has an externally threaded shaft 60*p* projecting rearward from its proximal end and held in threaded engagement with the internally threaded surface 60*j*.

In FIG. 4(D), the front end of the shank 60*a* is not externally threaded. The axial central hole 60*d* in the shank 60*a* which extends to and opens at the front end of the shank 60*a* has an internally threaded surface 60*q*. The cap 60*b* has a shaft 60*p* projecting rearward from its proximal end and comprising a thread-free shank 60*r* and an externally threaded surface 60*s* on the distal end of the shank 60*r*. The externally threaded surface 60*s* is positioned within the hole 60*d* beyond the internally threaded surface 60*q*, and the shank 60*r* is rotatably supported by the internally threaded surface 60*q*. Therefore, the internally threaded surface 60*q* serves as a bearing for the shank 60*r*.

In FIG. 4(E), the front end of the hole 60*d* terminates short of the front end of the shank 60*a*, and the cap 60*b* is of a tubular shape. The cap 60*b* has an annular flange 60*t* projecting radially inwardly which is axially sandwiched between the front end of the shank 60*a* and the bottom of a cylindrical case 60*u* that is disposed in the cap 60*b* and fixed to the front end of the shank 60*a* by a screw 60*x*. The annular flange 60*t* is thus positioned axially between the front end of the shank 60*a* and the bottom of the case 60*u*, so that the cap 60*b* is retained against removal from the shank 60*a*. An tubular bearing 60*v* of hard rubber or the like is mounted on an outer circumferential surface of the front end of the shank 60*a*. The cap 60*b* is rotatably supported on the tubular bearing 60*v*. An 0-ring 60*w* is interposed between the cap 60*b* and the case 60*u* for preventing a sludge from flowing into the cap 60*b*.

A drilling process performed by the rock drilling apparatus according to the present invention will be described below.

As shown in FIG. 2, a hole 17 has already been formed in a rock 19. First, the guide rod 60 is inserted into the hole 17 to fix the frame 1 stably in position with respect to rock 19.

Then, air or water is introduced under pressure from the rear end of the externally threaded proximal end 60*h* of the shank 60*a* into the hole 60*d* in the guide rod 60*d*. The introduced air or water flows from the hole 60*d* through the holes 60*e* into the gap between the bearing surface 60*k* and the tubular member 60*c*, and then flows through the gap out of the guide rod 60 from the axially opposite ends of the shank 60*c*. Since the air or water flows between the bearing surface 60*k* and the tubular member 60*c*, any friction between the shank 60*a* and the tubular member 60*c* is reduced, allowing the tubular member 60*c* to rotate smoothly around the shank 60*a*. At the same time, water is ejected from the holes 3*b* of the drill bit 3 as described above.

As the guide rod 60 is inserted into the hole 17, the guide rod 60 is secured with respect to the rock 19, and hence the bracket 7 is also secured with respect to the rock 19.

The rotary rod 4 is rotated about its own axis at high speed, and is axially moved forward to advance the drill bit 3 progressively for thereby drilling a hole in the rock 19 next to the hole 17.

When the drill bit 3 is moved forward away from the bracket 7 to deepen the hole, the rotary rod 4 is subjected to greater forces tending to displace or flex the rotary rod 4 toward the adjacent hole 17. The rotary rod 4 is now bent toward the hole 17 until an outer circumferential surface 3*a* of the drill bit 3 contacts the guide rod 60. The harder the rock 17, the greater the tendency for the rotary rod 4 to be bent toward the hole 17.

Heretofore, the outer surface of the guide rod 60 and the outer circumferential surface 3*a* of the drill bit 3 have been worn or broken by the rotation of the drill bit 3 in contact with the guide rod 60. In the rock drilling apparatus according to the invention, however, when the outer circumferential surface 3*a* of the drill bit 3 as it rotates contacts the guide rod 60, the tubular member 60*c* of the guide rod 60 is rotated by the rotation of the drill bit 3. With the modified guide rods shown in FIGS. 4(D) and 4(E), when the drill bit 3 is advanced to the front tip end of the guide rod 60 and contacts the cap 60*b*, the cap 60*b* is also rotated. Therefore, not only the tubular member 60*c*, but also the cap 60*b*, is rotated, so that the guide rod 60 is rotated substantially throughout its entire length.

Therefore, any friction between the outer circumferential surface of the guide rod 60 and the outer circumferential surface 3*a* of the drill bit 3 is very small, and the outer circumferential surface of the guide rod 60 and the outer circumferential surface 3*a* of the drill bit 3 are not unduly worn. Thus, the outer circumferential surface of the guide rod 60 and the outer circumferential surface 3*a* of the drill bit 3 are prevented from being unduly broken.

As a result, the guide rod 60 and the drill bit 3 do not need to be frequently replaced, and the efficiency of operation of the rock drilling apparatus is greatly increased. Even if the guide rod 60 and the drill bit 3 are brought into unduly frictional interference with each other, the drill bit 3 which is harder than the tubular member 60*c* is not broken, but only the tubular member 60*c* is broken or damaged, and needs to be replaced with a new one. Therefore, the rock drilling apparatus is highly economical.

Inasmuch as any friction between the outer circumferential surface of the guide rod 60 and the outer circumferential surface 3*a* of the drill bit 3 is very small, the rotational power of the drill bit 3 is substantially not reduced even when the drill bit 3 and the guide rod 60 contact each other.

Accordingly, the rock drilling apparatus is capable of drilling holes at high speed, and hence its efficiency of operation is also improved from this standpoint.

Because any friction between the guide rod 60 and the drill bit 3 is very small or almost nil, it is possible to position the guide rod 60 and the drill bit 3 closely to each other, and even to drill a hole while the guide rod 60 and the drill bit 3 are being kept in contact with each other from the start of the drilling process.

Even if the rotary rod 4 is somewhat bent in a direction away from the guide rod 60, the hole that is newly drilled by the drill bit 3 is necessarily joined at its inner end portion to the hole 17 in which the guide rod 60 is inserted. Accordingly, the holes are properly connected to each other deeply within the rod 19.

When the tubular member 60*c* is worn due to operation over a long period of time, the cap 60*b* may be detached, and only the tubular member 60*c* may be replaced with a new one. Since it is not necessary to replace the shank 60*a*, the rock drilling apparatus is relatively economical.

The water discharged from the drill bit 3, and the air or water discharged from the guide rod 60 are effective to discharge broken rook fragments smoothly from the hole being drilled by the drill bit 3. The smooth discharge of broken rock fragments allows the rock drilling apparatus to drill the hole at high speed.

However, the air or water may not necessarily be introduced into the rotary rod 4 and the guide rod 60, but may be introduced depending on how broken rock fragments are present in the newly drilled hole and how the hole is being drilled.

Although certain preferred embodiments of the present invention have been shown and described in detail, it should be understood that various changes and modifications may be made therein without departing from the scope of the appended claims.

What is claimed is:

1. A rock drilling apparatus comprising:

a frame having a front end;

a guide rod supported on said front end of the frame;

a rotary rod extending parallel to said guide rod and supported on said frame for rotation about its own axis and longitudinal movement beyond said front end of the frame; and a drill bit mounted on a front tip end of said rotary rod;

said guide rod comprising a shank fixed to said front end of the frame and a tubular member extending substantially fully over said shank and rotatably disposed around said shank.

2. A rock drilling apparatus according to claim 1, wherein said tubular member is made of a material which is less hard than said drill bit and said shank.

3. A rock drilling apparatus according to claim 2, wherein said shank and said tubular member are made of steel.

4. A rock drilling apparatus according to claim 1, wherein said shank has an outer circumferential bearing surface, said tubular member is rotatably fitted over said outer circumferential bearing surface, said shank has an air passage defined longitudinally axially therein, said air passage is open at a proximal end of said shank which is supported on said front end of the frame, and said air passage communicates with a plurality of openings defined at said outer circumferential bearing surface.

5. A rock drilling apparatus according to claim 4, wherein said guide rod further comprises a cap mounted on a tip end of said shank remote from said proximal end thereof, said air passage has an inner circumferential bearing surface, and said cap is rotatably supported on said inner circumferential bearing surface.

6. A rock drilling apparatus according to claim 1, wherein said shank has an outer circumferential bearing surface, said tubular member is rotatably fitted over said outer circumferential bearing surface, said shank has a water passage defined longitudinally axially therein, said water passage is open at a proximal end of said shank which is supported on said front end of the frame, and said water passage communicates with a plurality of openings defined at said outer circumferential bearing surface.

7. A rock drilling apparatus according to claim 6, wherein said guide rod further comprises a cap mounted on a tip end of said shank remote front said proximal end thereof, said water passage having an inner circumferential bearing surface, said cap being rotatably supported on said inner circumferential bearing surface.

8. A rock drilling apparatus according to claim 1, wherein a proximal end of said shank is fixed to the front end of said frame, said guide rod further comprises a cap mounted on a tip end of said shank remote from said proximal end thereof, said shank has an outer circumferential bearing surface at a tip end thereof remote from said front end of the frame, and said cap is rotatably supported on said outer circumferential bearing surface.

9. A rock drilling apparatus according to claim 1, wherein a proximal end of said shank is fixed to the front end of said frame, said guide rod further comprises a cap mounted on a tip end of said shank remote from said proximal end thereof, and said tubular member is held by said cap against movement toward said tip end of said shank.

10. A rock drilling apparatus according to claim 1, further comprising a bracket mounted on said front end of the frame, said guide rod being supported by said bracket, said rotary rod being longitudinally movable beyond said bracket, and said shank being fixed to said bracket.

11. A rock drilling apparatus comprising:

a frame having a front end;

a guide rod fixed to said front end of the frame;

a rotary rod extending parallel to said guide rod and supported on said frame for rotation about its own axis and longitudinal movement beyond said front end of the frame; a drill bit mounted on a front tip of said rotary rod; and at least a portion of said guide rod being rotatable about a longitudinal axis of said guide rod.

12. A rock drilling apparatus according to claim 11, wherein said guide rod comprises an outer tubular covering which is rotatable about the longitudinal axis of the guide rod.

13. A rock drilling apparatus according to claim 12, wherein said guide rod further comprises a shank fixed to said front end of the frame, and said outer tubular covering is rotatably disposed around said shank along substantially a full length of said shank.

14. A rock drilling apparatus according to claim 11, wherein said guide rod comprises a cap mounted on a free end thereof, said cap being rotatable about the longitudinal axis of said guide rod.

15. A rock drilling apparatus according to claim 12, wherein said guide rod further comprises a cap mounted on a free end thereof for restricting axial movement of said outer tubular covering along said guide rod.

16. A rock drilling apparatus according to claim 15, wherein said cap is also rotatable about the longitudinal axis of said guide rod, said outer tubular covering and said cap being separately supported by said guide rod for rotation.

17. A rock drilling apparatus according to claim 11, further including means for continuously supplying a lubricating fluid to said guide rod to facilitate rotation of said portion of the guide rod about the guide rod's longitudinal axis.

18. A rock drilling apparatus according to claim 13, wherein said shank has an outer circumferential bearing surface, said outer tubular covering is rotatably fitted over said outer circumferential bearing surface, said shank has a fluid passage defined longitudinally axially therein, said fluid passage is open at a proximal end of said shank which is supported on said front end of said frame, and said fluid passage communicates a plurality of openings defined at said outer circumferential bearing surface.

19. A rock drilling apparatus according to claim 12, wherein said outer tubular covering is made of the material which is less hard than said drill bit.

* * * * *

UNITED STATES PATENT AND TRADEMARK OFFICE

CERTIFICATE OF CORRECTION

PATENT NO. : 5,690,184

DATED : 25 November 1997

INVENTOR(S) : Toshiro Tsuchiya

It is certified that error appears in the above-indentified patent and that said Letters Patent is hereby corrected as shown below:

Column 1, line 63, change "tunnels'" to --tunnel's--.
Column 3, line numbered between 54 & 55, change "has a" to --has an--.
Column 5, line numbered between 50 & 51, change "An" to --A--;
line numbered between 54 & 55, change "0-ring" to --O-ring--
(change the bold number zero to the letter O);
line 66, change "guide rod 60d" to --guide rod 60--.
Column 7, line 18, change "rook" to --rock--.
Column 8, 10th line, change "front" to --from--;
12th line, after the comma insert --and--.

Signed and Sealed this

Twenty-fourth Day of February, 1998

*Attest:*

Bruce Lehman

BRUCE LEHMAN

*Attesting Officer*

*Commissioner of Patents and Trademarks*